United States Patent [19]

Crucefix

[11] Patent Number: 4,870,547

[45] Date of Patent: Sep. 26, 1989

[54] CHRISTMAS TREE LIGHTS

[76] Inventor: Michael D. Crucefix, Suite 2, 516 Marcellus Avenue, Milton, Ontario, Canada, L9T 4E8

[21] Appl. No.: 260,589

[22] Filed: Oct. 21, 1988

[51] Int. Cl.[4] ..... F21P 1/02

[52] U.S. Cl. ..... 362/123; 362/800; 362/227; 315/185 S; 315/192

[58] Field of Search ..... 362/108, 122, 123, 800, 362/806, 227; 315/185 R, 185 S, 191, 192

[56] References Cited

U.S. PATENT DOCUMENTS

| | | | |
|---|---|---|---|
| 1,728,938 | 9/1929 | Kirschstein | 315/192 |
| 2,242,597 | 5/1941 | Quandee | 240/10 |
| 2,298,089 | 10/1942 | Veenboer | 362/123 |
| 2,453,695 | 11/1948 | Belling | 240/10 |
| 3,603,780 | 9/1971 | Lu | 362/123 |
| 3,723,723 | 3/1973 | Lerner | 240/10 |
| 3,770,951 | 11/1973 | Corelli | 240/10 |
| 4,223,248 | 9/1980 | Tong | 315/185 S |
| 4,516,193 | 5/1985 | Murphy | 362/123 |
| 4,631,650 | 12/1986 | Ahroni | 362/806 |
| 4,679,126 | 7/1987 | Van Sickler | 362/806 |
| 4,720,773 | 1/1988 | Ahroni | 362/249 |
| 4,736,282 | 4/1988 | Ahroni | 362/123 |

*Primary Examiner*—Carroll B. Dority

*Attorney, Agent, or Firm*—Riches, McKenzie & Herbert

[57] ABSTRACT

A Christmas tree light assembly having a collar to couple strings of series and parallel connected lights together with junctures to connect the light strings together in parallel comprising three-wire lamp receptacles spaced from the collar means so that only preinsulated wires pass through the collar supporting the light strings.

14 Claims, 5 Drawing Sheets

PRIOR ART

CHRISTMAS TREE LIGHTS

SCOPE OF THE INVENTION

This invention relates to lighting strings for Christmas trees and, more particularly, to a novel configuration for a Christmas tree light assembly.

BACKGROUND OF THE INVENTION

In the past, Christmas tree lighting assemblies have been known which provide a plurality of discrete dependent strings of series connected lamp elements which extend downwardly from a collar mounted about the top of a Christmas tree. Known systems are disclosed in U.S. Pat. No. 3,770,951 to Corelli and U.S. Pat. No. 3,723,723 to Learner.

Devices in accordance with these patents suffer a number of disadvantages. In each numerous electrical connections are required between strings of lights connected in parallel. The considerable number of connections provides a centralized location where overheating may arise. In view of this requirement, each of the patents require a substantial and rather unique coupling assembly to accomodate the numerous connections. Such coupling assemblies are expensive and inconvenient to manufacture.

SUMMARY OF THE INVENTION

To at least partially overcome the disadvantages of previously known devices, the present invention provides a Christmas tree light assembly having a collar to couple strings of series and parallel connected lights together with junctures to connect the light strings together to be conveniently spaced from the collar so that only preinsulated wire need pass through the collar supporting the light strings.

An object of this invention is to provide a Christmas tree light assembly of simple and economical construction whereby a string of lights can easily be arranged on a Christmas tree.

Another object is to provide a simple construction for a Christmas tree light assembly which utilizes simple and inexpensive commercially available receptacles and junctures to connect lights in series and in parallel without the need for special junctions or terminals and without the need to conceal or locate any terminals or junctures within a collar to support the assembly about a tree.

Another object is to provide a simple and economical configuration whereby a number of strings each comprising series connected lights may conveniently be connected in parallel so as to provide on a single light string a sufficient number of conventional lights adequate to entirely light a typical Christmas tree.

Accordingly, in one of its aspects, the present invention provides a Christmas tree light assembly comprising:

collar means adapted to removably surround the trunk of a Christmas tree near the top of the tree, the collar means having a first end; a second end, support passageway means defined circumferentially therewithin extending substantially from the first end to the second end; and a row of circumferentially spaced apertures opening into the passageway means, light wiring circuit means supported by the collar means and comprising:

a first string of series connected lamps between two insulated connector lead wires connected to a plug connector for a wall outlet; and a second string of series connected lamps between two insulated juncture lead wires;

the second string connected to the first string in parallel by the wire juncture leads at two junctures, said junctures comprising a pair of three-wire lamp receptacles in the first string, the first and second strings otherwise than in said junctures substantially comprising a plurality of double lamp light receptacles spaced by segments of single-strand insulated wire connecting adjacent receptacles, the receptacles of each string arranged in a plurality of loops with wire segments of each loop coupled together to provide each loop as a discrete elongate strand of a plurality of spaced receptacles extending to a remotely locatable free end of the strand, the strands extending from the passageway out the apertures to the free ends with wire segments connecting strands together passing through the passageway retained therein, said junctures being provided on strands of the first string at locations proximate the coupling means but spaced therefrom with the wire juncture leads connecting the second string to the first string passing through the passageway substantially retained therein.

BRIEF DESCRIPTION OF THE DRAWINGS

Further objects and advantages of the present invention will be apparent from the following description of preferred embodiments of the invention described with reference to the following drawings in which.

DETAILED DESCRIPTION OF THE DRAWINGS

Figure 1:
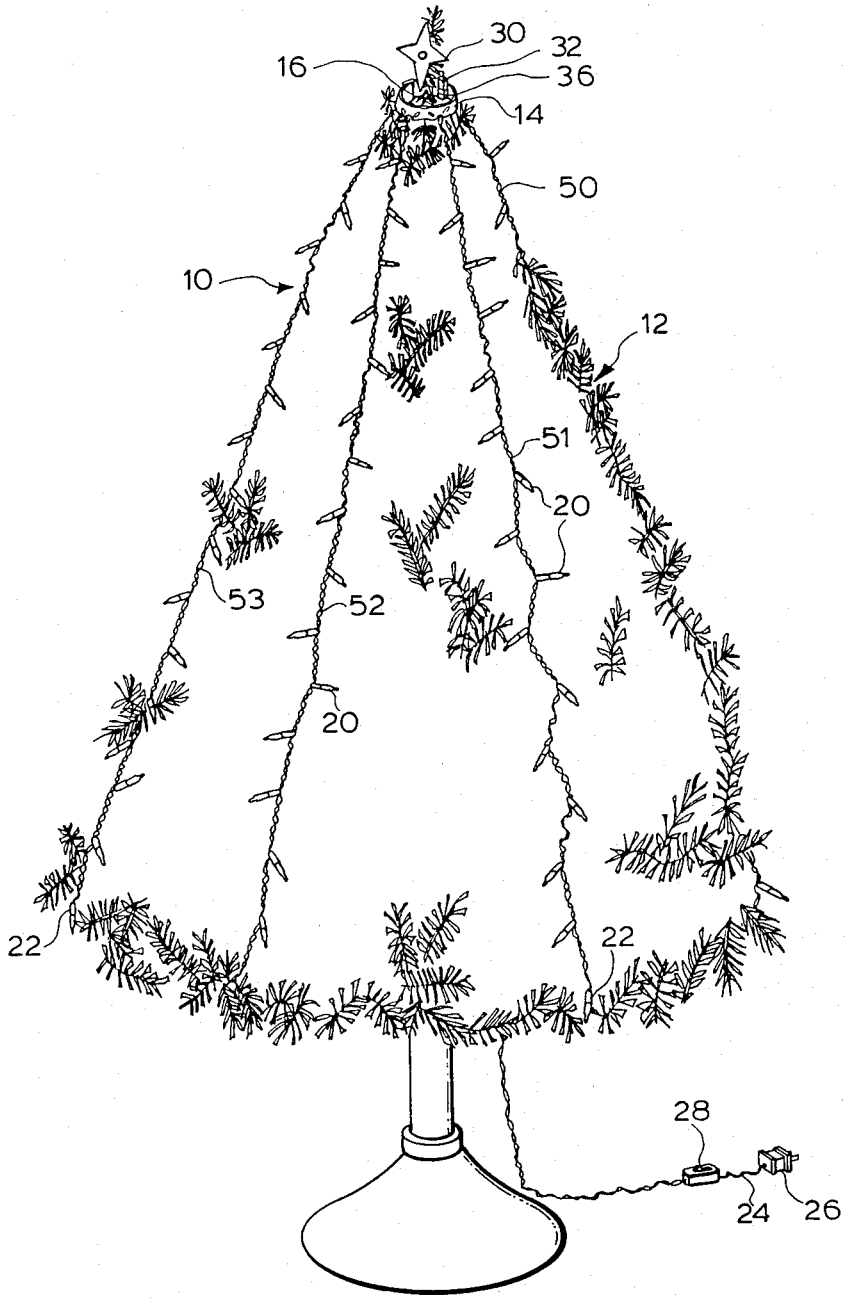
FIG. 1 is a pictorial view showing the position of the mounting collar and dependent strands of lights on a Christmas tree, and including an optional tree top decoration.

Reference is made first to FIG. 1 which shows a Christmas tree light assembly generally indicated as 10 in accordance with the present invention in place decorating a Christmas tree 12. Mounting collar 14 removably wraps around trunk 16 of tree 12 near its top and preferably is, to some extent, hidden by the surrounding branches. Mounting collar 14 suspends strands of lights of which four strands are visible as 50, 51, 52 and 53. Collar 14 may substantially bear the weight of the strands. Each strand has a number of lamps generally indicated as 20 spaced along its length. Each of these strands extend from the mounting collar 14 to a remotely locatable free end 22 of the strand. A power cord 24 extends from mounting collar 14 to a plug connector 26 for a known electrical wall outlet. A switch 28 may be provided in the power cord.

In use of the assembly in accordance with the present invention, mounting ring 14 is secured about the trunk 16 of the Christmas tree near the top of the tree. Discrete individual strands can then individually be placed in and about the branches of the tree so as to generally extend downwardly. The provision of the discrete strands with their remotely locatable free ends 22 facilitates and speeds up light placement.

FIG. 1 also shows an optional tree top ornament, namely, an electrically lighted star 30. While not clearly shown, as will later be described with reference to FIG. 6, a power cord 32 from star 30 has a plug connector for electrical connection to an optical socket connector 36 provided on the embodiment of the invention of the present application shown in FIGS. 1 and 6.

Figure 3:
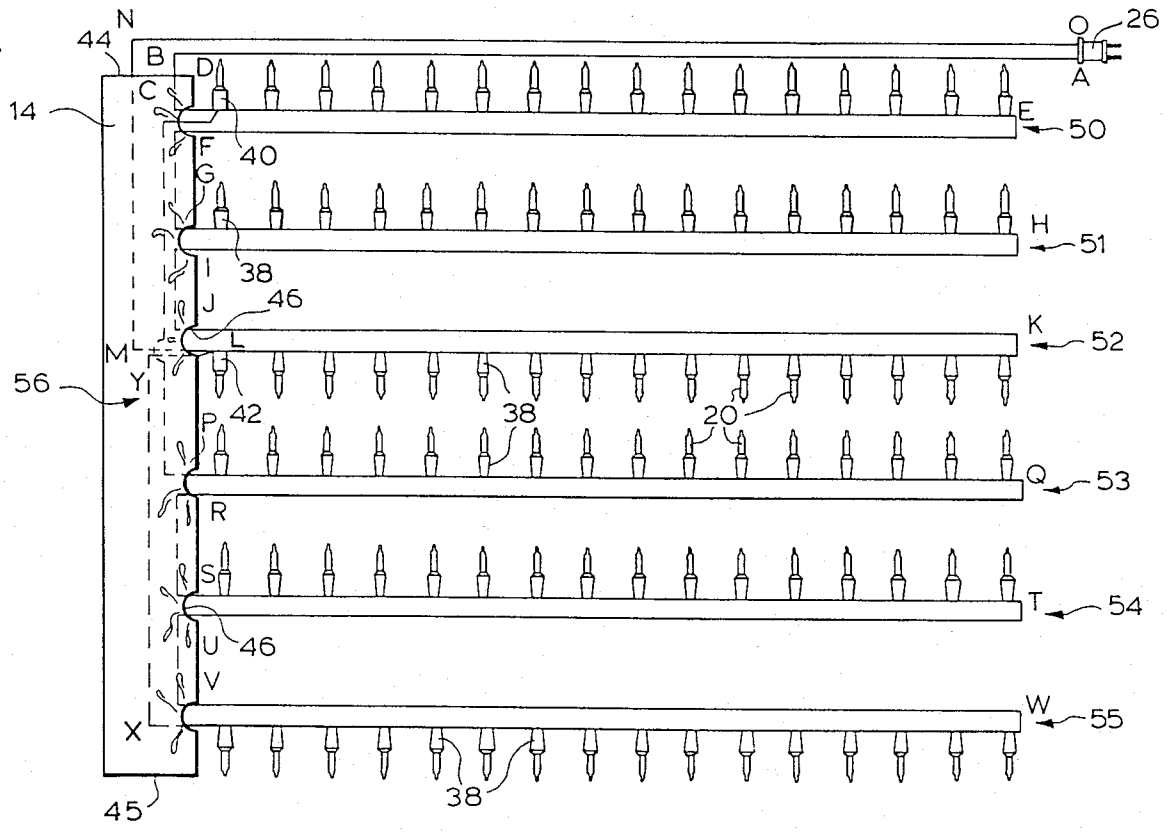
FIG. 3 is a schematic representation of one embodiment of a wiring circuit and the mounting collar in accordance with this invention.

Reference is now made to FIG. 3 showing a schematic representation of a preferred wiring diagram in accordance with a second embodiment of the present invention. In FIG. 3, the straight black lines represent lengths of continuous insulated single-strand wire. A plurality of double wire lamp receptacles are generally indicated as 38. In FIG. 3, there are also shown only two triple wire lamp receptacles 40 and 42. All the remaining lamp receptacles in FIG. 3 are double wire lamp receptacles 28. To assist description of the wire in the circuits, at selected bends and junctures of the wire, reference numerals A to Y have been provided and different lengths of the wire in a circuit will be described by reference to these letters.

FIG. 3 is a schematic view showing not only the wiring circuit of the assembly, but also the relative location of different elements comprising the wire assembly as juxtapositioned relative to mounting collar 14 with openings to mounting collar 14 effectively shown at one end 44 and along one side 45 a plurality of spaced downward opening apertures 46.

The wiring circuit comprises a first string of series connected lights represented by the wiring segment outlined by following letters A to 0 in sequence through B. This first light string has its receptacles whether double wire lamp receptacles 38 or the two triple wire lamp receptacles 40 and 42 connected in series. The first light string is connected to plug connector 26 by two insulated connector lead wires being wire segments AB and NO. Along each of wire segments CE, GE and KM, the first light string comprises a plurality of lamp receptacles spaced by individual smaller segments of single-strand insulated wire which connects the adjacent recptacles. The receptacles of the first light string are arranged into three loops shown as CEF, GHI and JKL. While not shown in FIG. 3, the wire segments and receptacles comprising each loop are coupled together so as to provide each loop as a discrete elongate strand, namely, strands 50, 51 and 52 corresponding to the strands shown in FIG. 1. Each strand includes a plurality of spaced receptacles and extends to a remotely locatable free end as at E, H and K. Preferably, the wire segments of each loop may be coupled together as by a simple twisting as, for example, of wire segments CEF about the wire segments and receptacles provided along lengths DE and EF. Strand 50 is coupled to strand 51 by wire segment FG. Similarly, strand 51 is coupled to strand 52 by wire segment IJ. Wire segments BC and MN connect strands 50 and 52 to the wire juncture leads AB and NO. The circuit includes a second light string of series connected lamp receptacles comprising circuitry formed by wire segment DPQRSTOVWL. This second circuit, as shown in FIG. 3, is entirely made up of series connected double wire lamp receptacles also indicated 38. The receptacles of second string are arranged in three loops, JKL, PQR and STU. The wire segments of each loop are coupled together to provide each loop as a discrete elongate strand of a plurality of receptacles extending to a remotely locatable free end, indicated as points Q, T and W, respectively. The wire segments in each loop may be coupled together as being twisted to form individual strands indicated 53, 54 and 55. Wire segments RS connect strands 53 to strands 54 and wire segment UV connects strand 54 to strand 55. Wire strand PD and LYX are insulated wire juncture leads which couple the strands of the second light string to the first light string at three-wire lamp terminals 40 and 42, respectively. By such coupling, the second light string is connected in parallel with the first light string. As seen in FIG. 3, each of strands 50 to 55 extend out from mounting collar 14 through an aperture 46 to the respective discrete ends of the strands. Portions of the wire segments which connect the strands together, pass internally through the mounting collar 14 from one aperture 46 to another via a passageway generally indicated 56 within the mounting collar. Thus, wire segments FG, IJ, RS and UV are within mounting collar 14. The wire segments which substantially extend from the ends of the strands of the second light string to the triple wire receptacles 40 and 42 of the first light string, namely, wire segments PD and XYL are also within mounting collar 14 as are the wire segments CB and MN, which connect the strands of the first light string to the connector lead wires.

Use of the triple wire lamp receptacles 40 and 42 provides an advantageous system for coupling of the second light string to the first light string in a parallel relation. Preferably, both the triple wire receptacles 40 and 42 are disposed on strands 50 and 51 of the first light string close to mounting collar 14 so as to minimize the extent to which wire segments PD or XYL extend from mounting collar 14.

The particular arrangement of the wire segments as shown in FIG. 3 advantageously permit merely preinsulated wires to pass through and be received within mounting collar 14 so that all electrical junctions are made outside of mounting collar 14. This facilitates the use of conventional coupling junctures such as the double and triple wire lamp receptacles. This also eliminates the need for any particular specialized juncture or configuration within mounting collar 14 in order to advantageously pass Canadian Standards Association electrical certification and approval.

Figure 2:
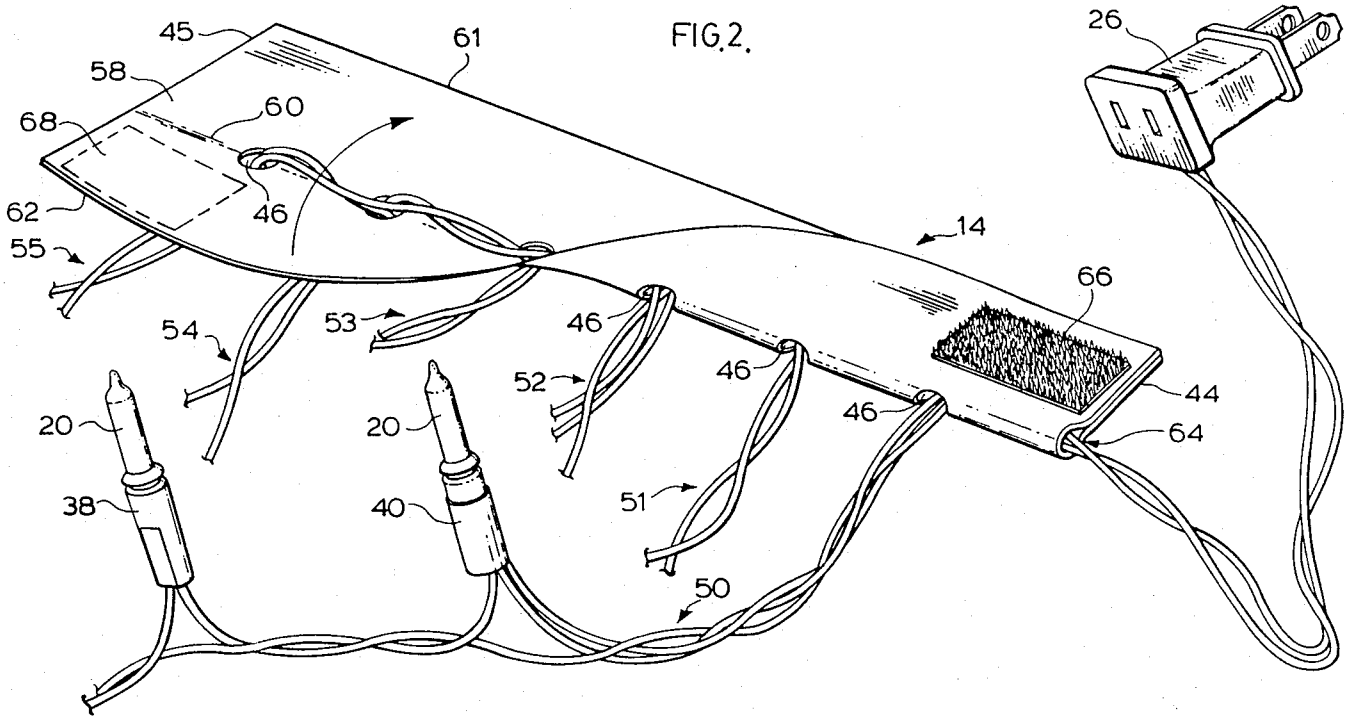
FIG. 2 is a schematic enlarged pictorial representation of the mounting collar from FIG. 1 and showing upper portions of the strands extending therefrom.

Reference is now made to FIG. 2 which shows an enlarged pictorial view of the mounting collar partially open to show its construction. In FIG. 2, strands 50 to 55 may clearly be seen to extend out of apertures 46 in the mounting collar 14. The mounting collar may be seen to comprise a planar sheet of flexible material 58 such as polyproplylene or sonic weldable vinyl which is provided with circular apertures 46 along its longitudinal center fold line 60. The side edges 61 and 62 of the sheet are folded upwardly to overlie each other and be secured together at least along these edges so as to form a longitudinally extending passageway 64 open at a first end 44 and also at each of the apertures 46. More preferably, pre-folded vinyl sheets may be sealed together over the entirety of the surfaces to effectively capture and retain the wire segments laid therebetween.

Coupling devices may be provided so as to couple the first end 44 of the mounting collar to its second end 45. A preferred coupling system is a touch fastening system such as the well-known VELCRO trade mark touch fastening system with a hook forming pad 66 disposed at a first end 44 and eyelet forming pad 68 provided at a second end 45.

Figure 6:
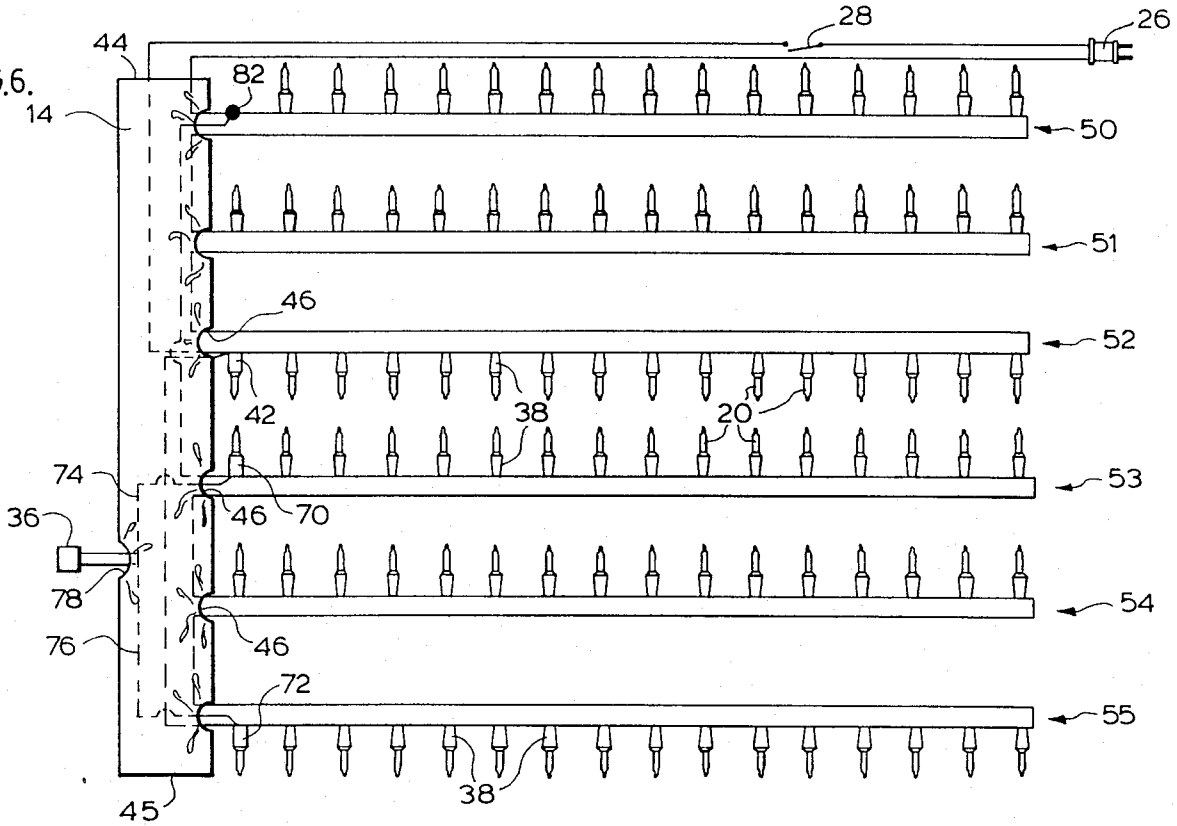
FIG. 6 is a schematic representation of a second embodiment of a wiring circuit and mounting collar as shown in FIG. 1 and including an optional extension socket.

Reference is made now to FIG. 6 which shows a second embodiment of a wiring circuit in accordance with the present invention.

FIG. 6 is identical to FIG. 1 other than in three features. The first feature, an off/on electrical switch 28 is disposed in the power cord for a matter of convenience. Secondly, the three-wire lamp receptacle 40 has been replaced by a conventional three-way coupling generally indicated as a solid dot 82.

A third parallel line generally indicated 84 has been added coupled in parallel to second light string 56. To accomodate this third light string, the lamp receptacles of strands 53 and 55 closest to collar 14 have been replaced by three-wire lamp receptacles 70 and 72. Wire segments 74 and 76 substantially extend from these lamp receptacles through apertures 46 and within mounting collar 14 to where they pass through upwardly directed aperture 78 in the mounting collar as extension lead wires for socket connector 36 adapted to receive a conventional plug from a Christmas top decoration such as that of top cord 32 from star 30 as seen in FIG. 1.

Figure 4:
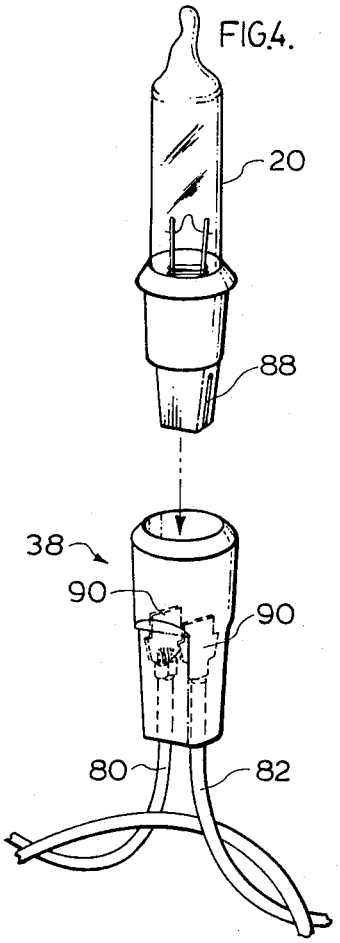
FIG. 4 is a schematic pictorial representation of a prior art two-wire lamp receptacle with a lamp therefor.
Figure 5:
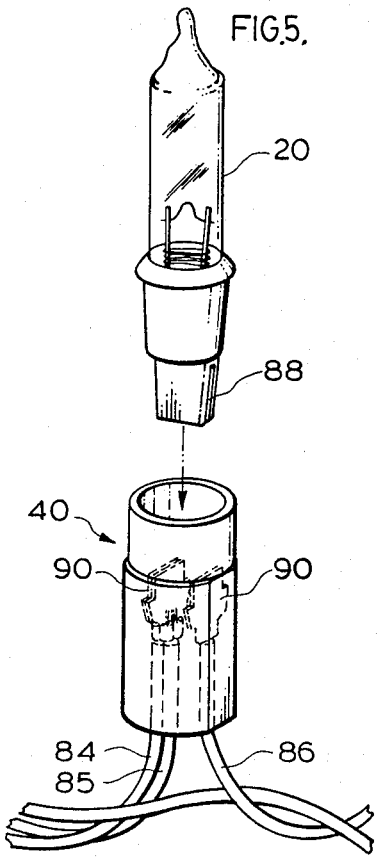
PRIOR ART FIG.5.
FIG. 5 is a schematic pictorial representation of a prior art three-wire lamp receptacle with a lamp therefor.

FIG. 4 shows a preferred type of a prior art two-wire lamp receptacle 38 for use in accordance with the present invention. Such receptacles have a removable lamp 20. The lamp 20 preferably has an internal shunt in parallel with the filament which carries current when a filament opens so that upon failure of the filament, the burnt out lamp does not render the series circuit incomplete. The receptacle receives two wire segments 80 and 82. FIG. 5 shows a known prior art type of a similar three-wire lamp receptacle identical to the receptacle of FIG. 4 but permitting connection of two wires 84 and 85 to one side of the lamp and one wire 86 to the other side. The lamps 20 have connection wires 88 on each side for contact with plates 90 in each receptacle.

The preferred embodiments show the collar as a flexible sheet of plastic which requires its ends to be attached to couple the collar about the tree. The collar may take many forms including resilient C-shaped collars which may be flexed to fit about the tree and due to their resiliency would remain about the trunk.

A collar having a number of tabs or hook-like portions such as that shown in USP 4,720,773 may be used, in which case the passageway is conceptionally formed by the wires being engaged behind the tabs.

In the preferred embodiment, the lamps are each 2.5 volt with 16 lamps on each strand for a total of 48 lamps on each string representing 120 volts total. While only two parallel strings are shown, third additional strings can be provided in parallel with the first and second string. The number of lamps and their voltages may be adjusted as desired, as may the number of strands per each string.

The assembly can be fashioned either for indoor or outdoor use.

While the invention has been described with reference to preferred embodiments, it is not so limited. Any modifications and variations will now occur to those skilled in the art. For a definition of the invention, reference is made to the appended claims.

What I claim is:

1. A Christmas tree light assembly comprising:

collar means adapted to removably surround the trunk of a Christmas tree near the top of the tree, the collar means having a first end, a second end, support passageway means defined circumferentially therewithin extending substantially from the first end to the second end, and a plurality of circumferentially spaced apertures opening into the passageway means, light wiring circuit means supported by the collar means, the circuit means comprising:

a first string comprising of a plurality of lamps each in a lamp receptacle connected in series spaced apart by segments of single-strand, continuously-insulated wire;

two single-strand, insulated connector lead wires connecting a respective last lamp receptacle at each end of the first string to a plug connector for a wall plug;

a second string comprising of a plurality of lamps each in a lamp receptacle connected in series spaced apart by segments of single-strand, continuously-insulated wire; and two single-strand, insulated junction lead wires connecting a respective last lamp receptacle at each end of the second string to the first string to couple the first string and second string together in parallel, the lamp receptacles of each string arranged in a plurality of loops with said wire segments of each loop coupled together to provide each loop as a discrete elongate strand of a plurality of spaced lamp receptacle extending to a remotely locatable free end of the strand, each strand extending from the passageway means out one of the apertures to its free end with:

(a) wire segments which connect one strand to another passing between apertures through the passageway means;

(b) the junction lead wires connecting the second string and the first string together passing through the passageway means via the apertures; and (c) all lamp receptacles located externally of and spaced from the collar means, whereby no electrical connections are made within the collar means.

2. An assembly as claimed in claim 1 wherein all wiring passing through the passageway means is continuously-insulated wire.

3. An apparatus as claimed in claim 2 wherein the junction lead wires connect to the first string at two different lamp receptacles on the first string.

4. An assembly as claimed in claim 3 wherein electrical connections are made in the circuit means only at the lamp receptacles and the plug connector.

5. An assembly as claimed n claim 3 wherein the two different lamp receptacles where the juncture lead wires connect to the first string comprise three-wire lamp receptacles and the remainder of the lamp receptacles in the circuit means comprise two-wire lamp receptacles.

6. An assembly as claimed in claim 5 where electrical connections are made only at the lamp receptacles and the plug connector.

7. An assembly as claimed in claim 2 wherein said connector lead wires pass from strands of the first string through the passageway and out an aperture to the plug connector.

8. An assembly as claimed n claim 4 wherein said pair of three-wire lamp receptacles are located in different strands of the first string.

9. An assembly as claimed in claim 1 including a third circuit connected in parallel with the first and second circuits and comprising a pair of extension lead wires connected to a socket connector.

10. An assembly as claimed in claim 1 wherein said collar means comprises an elongate flexible strip of sheet material with longitudinally spaced apertures therethrough through which the strands extend, the strip folded about a longitudinally extending fold line to define the passageway longitudinally therethrough.

11. An assembly as claimed in claim 10 wherein longitudinal edges of said strip are sealed together.

12. An assembly as claimed in claim 11 wherein attachment means are provided to secure each longitudinal end of the flexible strip together about the trunk of the Christmas tree.

13. An assembly as claimed in claim 1 wherein coupling means are provided to secure the first end of the collar means to the second end of the collar means.

14. An assembly as claimed in claim 13 wherein said collar means comprises an elongate flexible strip of sheet material folded about a longitudinally extending fold line to define said passageway means longitudinally therethrough.

* * * * *